United States Patent [19]

Johnson et al.

[11] Patent Number: 4,861,427

[45] Date of Patent: Aug. 29, 1989

[54] BACTERIAL CELLULOSE AS SURFACE TREATMENT FOR FIBROUS WEB

[75] Inventors: Donald C. Johnson, Auburn; Amar N. Neogi, Seattle; Henry A. LeBlanc, Federal Way, all of Wash.

[73] Assignee: Weyerhaeuser Company, Tacoma, Wash.

[21] Appl. No.: 166,283

[22] Filed: Mar. 10, 1988

Related U.S. Application Data

[63] Continuation-in-part of Ser. No. 45,985, May 4, 1987, abandoned.

[51] Int. Cl.[4] ..... D21F 11/00; D21H 5/12

[52] U.S. Cl. ..... 162/129; 162/13; 162/99; 162/130; 162/135; 162/141; 162/142; 162/148; 162/150; 162/157.6

[58] Field of Search ..... 162/1, 99, 13, 141, 162/142, 148, 150, 135, 157.6, 177, 129, 130, 187, 176; 427/395

[56] References Cited

U.S. PATENT DOCUMENTS

| | | | |
|---|---|---|---|
| 1,924,573 | 8/1933 | Schur | 162/187 |
| 2,026,253 | 12/1935 | Sanborn | 162/158 |
| 2,999,786 | 9/1961 | Downs et al. | 162/129 |
| 3,839,144 | 10/1974 | Louden | 162/141 |
| 4,320,198 | 3/1982 | Mynatt | 435/101 |
| 4,374,702 | 2/1983 | Turbak | 162/187 |
| 4,378,431 | 3/1983 | Brown | 435/101 |

FOREIGN PATENT DOCUMENTS

| | | |
|---|---|---|
| 988945 | 1/1983 | U.S.S.R. . |
| 580595 | 9/1946 | United Kingdom . |
| 8503316 | 8/1985 | World Int. Prop. O. . |

OTHER PUBLICATIONS

Kai, "The Influence of Culture Conditions of the Fibrillation of Cellulose Gel Produced by Acetobacter Xylinum," Bull. Chem. Soc., Japan, vol. 57, No. 10, (Oct. 1984), pp. 2816–2819.

C & EN, vol. 63, No. 38, (Sep. 23, 1985), "Studies Shed More Light on Cellulose Structure," p. 40.

*Primary Examiner*—Peter Chin

[57] ABSTRACT

A fibrous web product with a surface treatment containing bacterial cellulose and a method of surface treating such fibrous webs. The bacterial cellulose is applied to at least one surface of a fibrous web, to make products such as printing material suitable for magazines or advertisements, by use of conventional paper manufacturing equipment. The bacterial cellulose may be applied singularly or in combination with other materials such as fillers or pigments. Bacterial cellulose applied at relatively low concentrations gives excellent properties of gloss, smoothness, ink receptivity and holdout, and surfaces strength.

21 Claims, 3 Drawing Sheets

BACTERIAL CELLULOSE AS SURFACE TREATMENT FOR FIBROUS WEB

This application is a continuation-in-part of application Ser. No. 045,985, filed May 4, 1987 now abandoned.

BACKGROUND OF THE INVENTION

The present invention is a fibrous web product with a surface treatment containing bacterial cellulose and a method of surface treating such fibrous webs with bacterial cellulose. A particularly useful bacterial cellulose is one formed in aerated, agitated culture using a microorganism of the genus Acetobacter genetically selected for cellulose production under agitated conditions. Papers having the bacterial cellulose surface treatment have printing characteristics which approach or equal high quality coated offset papers.

It has been known for many years that cellulose can be synthesized by certain bacteria, particularly those of the genus Acetobacter. However, taxonomists have been unable to agree upon a consistent classification of the cellulose producing species of Acetobacter. For example, the cellulose producing microorganisms listed in the 15th Edition of the Catalog of the American Type Culture Collection under accession numbers 10245, 10821 and 23769 are classified both as *Acetobacter aceti subsp. xylinum* and as *Acetobacter pasteurianus.* For the purposes of the present invention any species or variety of bacterium within the genus Acetobacter that will produce cellulose under agitated conditions should be regarded as a suitable cellulose producer for the purposes of the present invention.

*Acetobactor aceti subsp. xylinium* is normally cultured under static conditions with the cellulose microfibrils being produced at the air medium interface. Most bacteria of this species are very poor cellulose producers when grown in agitated culture. One reason proposed for such poor production is that an agitated culture induces a tendency to mutation to noncellulose producing strains. In contrast, the Acetobacter strains according to the present invention are characterized by an ability to produce large amounts of cellulose in agitated culture without manifesting instability leading to loss of cellulose production in culture.

An earlier United States patent application, Ser. No. 788,915, filed Oct. 18, 1985 disclosed Acetobacter varieties which are vigorous cellulose producers under agitated culture conditions. The cellulose produced by the microorganisms and culture conditions disclosed in this application appears to be a unique type, physically quite different from the bacterial cellulose produced in static cultures. It has a highly branched, three dimensional, reticulated structure. A normal cellulose pellicle produced in static culture tends to have a lamellar structure with significantly less branching. The present invention involves the use of bacterial cellulose produced by such microorganisms under agitated conditions as a surface treatment for fibrous webs.

The need for static conditions for production of cellulose is disclosed in U.S. Pat. No. 4,588,400 (filed Dec. 16, 1982), which maintains the culturing material in a substantially motionless condition during cell growth and cellulose production. U.S. Pat. No. 4,588,400 describes formation of a bacterial pellicle, under static or motionless conditions, which is ultimately said to be usable as a wound dressing. Intermittent agitation produces fibrils of finite length which is determined by the linear extension rate of the fibril and the period between agitative shearing of the fibril from the surface of the microorganism. Nothing, however, is disclosed about the effects of continuous agitation on the cellulose product or about the production of a highly branched, three dimensional, reticulated fibrillar structure under either static or agitated conditions, nor about the use of bacterial cellulose as a surface treatment for fibrous webs.

SUMMARY OF THE INVENTION

Surface treatments commonly used to provide good quality printing surfaces for commercial and publication papers are commonly mixtures containing clay, latex and starch binders. Typically, the mixture is applied to the printing surface with a coater and the final surface characteristics, after drying, are developed by passing the coated surface through a supercalender.

The present invention comprises the application of bacterial cellulose to at least one surface of a fibrous web. Products of such application are numerous and include printing papers suitable for high quality magazines. These can be made on conventional paper manufacturing equipment, which would include fourdriniers, multi-ply or twin wire machines. The bacterial cellulose may be applied during wet formation, as from a secondary headbox, or it may be applied to a partially or wholly dried sheet by a size press or off machine coater. After applying the bacterial cellulose, gloss and other important printing characteristics, such as smoothness, can be significantly improved by a simple calendering treatment. An exposure of the bacterial cellulose surface treated fibrous web to heat and pressure enhances the printing properties. In this way, paper with excellent printing surfaces can be obtained even without the use of complicated coating systems or the use of supercalenders. With the use of a supercalender, one would expect even greater enhancement of properties such as surface smoothness.

Additionally, the bacterial cellulose may be combined with other materials such as mineral or organic pigments or fillers and starch or other polymeric additives to provide different properties. The surface treatment with bacterial cellulose alone enhances surface properties, such as gloss, smoothness, ink receptivity and holdout, and surface strength.

Sheet products with a surface treatment of bacterial cellulose at low concentrations display a higher differential or "snap" between the printed ink gloss and the sheet gloss than do many commercially available offset and rotogravure printing materials. In addition, bacterial cellulose treated products display a higher degree of sheet smoothness and ink holdout than the untreated control sheets.

The term "bacterial cellulose" as used in this invention refers to a product essentially free of residual bacterial cells made under agitated culture conditions by a bacterium of the genus Acetobacter. The strains of bacteria employed may be any having similar characteristics to those grown as a subculture of ATCC Accession No. 53-263, deposited Sept. 13, 1985 under the terms of the Budapest Treaty.

It is an object of the present invention to provide a method for surface treatment of fibrous webs with bacterial cellulose alone or in combination with other materials.

It is a further object to provide a superior quality paper product having improved surface characteristics such as gloss, smoothness and ink receptivity and hold-out.

It is a further object to provide excellent printing surfaces using conventional paper mill equipment.

These and many other objects will become readily apparent on reading the following detailed description taken in conjunction with the attached drawings.

BRIEF DESCRIPTION OF THE DRAWINGS

FIG. 3 is a micrograph of a calendered Noble and Wood control sheet without any top layer of bacterial cellulose. FIG. 4 is a micrograph of a calendered Noble and Wood sheet with a top layer of bacterial cellulose.

DESCRIPTION OF THE PREFERRED EMBODIMENT

Figure 1:
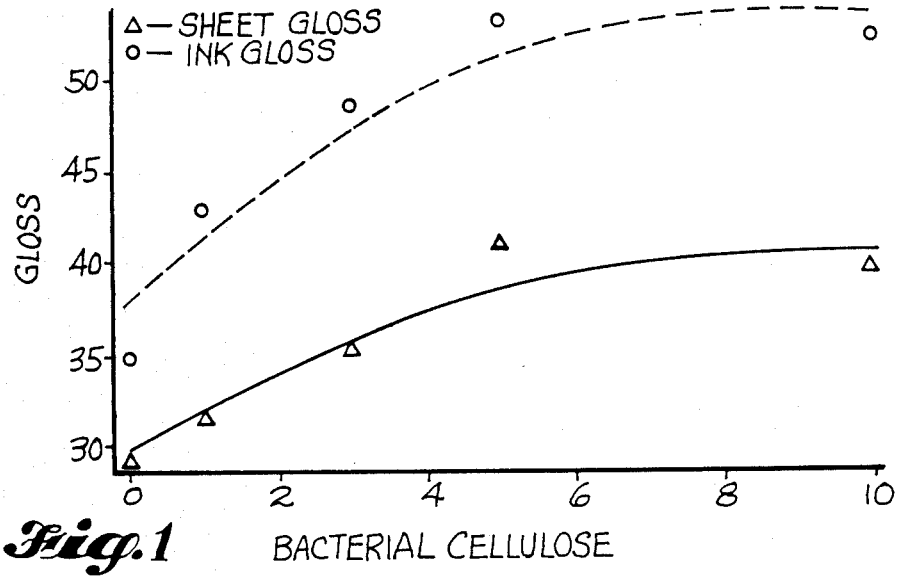
FIG. 1 is a comparison of sheet gloss and printed ink gloss to demonstrate the gloss difference of various papers.

The procedures of the present invention are best understood by reference to the following examples.

EXAMPLE 1

Production of Bacterial Cellulose

The bacterial cellulose of the present invention was produced in agitated culture by a strain of *Acetobacter aceti* var. *xylinum* grown as a subculture of ATCC Accession No. 53-263, deposited Sept. 13, 1985 under the terms of the Budapest Treaty, under conditions similar to the following Example 1.

The following base medium was used for all cultures. This will be referred to henceforth as CSL medium.

| Ingredient | Final Conc. (mM) |
|---|---|
| $(NH_4)_2SO_4$ | 25 |
| $KH_2PO_4$ | 7.3 |
| $MgSO_4$ | 1.0 |
| $FeSO_4$ | 0.013 |
| $CaCl_2$ | 0.10 |
| $Na_2MoO_4$ | 0.001 |
| $ZnSO_4$ | 0.006 |
| $MnSO_4$ | 0.006 |
| $CuSo_4$ | 0.0002 |
| Vitamin mix | 10 mL/L |
| Carbon source | As later specified |
| Corn Steep liquor | As later specified |
| Antifoam | 0.01% v/v |

The final pH of the medium was 5.0±0.2.

The vitamin mix was formulated as follows:

| Ingredient | Conc. mg/L |
|---|---|
| Inositol | 200 |
| Niacin | 40 |
| Pyridoxine HCl | 40 |
| Thiamine HCl | 40 |
| Ca Pantothenate | 20 |
| Riboflavin | 20 |
| p-Aminobenzoic acid | 20 |
| Folic acid | 0.2 |
| Biotin | 0.2 |

Corn steep liquor (CSL) varies in composition depending on the supplier and mode of treatment. A product obtained as LOT E804 from Corn Products Unit, CPC North America, Stockton, Calif. may be considered typical and is described as follows:

| Major Component | % |
|---|---|
| Solids | 43.8 |
| Crude protein | 18.4 |
| Fat | 0.5 |
| Crude fiber | 0.1 |
| Ash | 6.9 |
| Calcium | 0.02 |
| Phosphorous | 1.3 |
| Nitrogen-free extract | 17.8 |
| Non-protein nitrogen | 1.4 |
| NaCl | 0.5 |
| Potassium | 1.8 |
| Reducing sugars (as dextrose) | 2.9 |
| Starch | 1.6 |

The pH of the above is about 4.5.

The bacteria were first multiplied as a pre-seed culture using CSL medium with 4% (w/v) glucose as the carbon source and 5% (w/v) CSL. Cultures were grown in 100 mL of the meidum in a 750 mL Falcon #3028 tissue culture flask at 30° C. for 48 hours. The entire contents of the culture flask was blended and used to make a 5% (v/v) inoculum of the seed culture. Preseeds were streaked on culture plates to check for homogeneity and possible contamination.

Seed cultures were grown in 400 mL of the above-described medium in 2 L baffled flasks in a reciprocal shaker at 125 rpm at 30° C. for two days. Seed cultures were blended and streaked as before to check for contamination before further use.

Bacterial cellulose was initially made in a continuously stirred 14 L Chemap fermentor using a 12 L culture volume inoculated with 5% (v/v) of the seed cultures. An initial glucose concentration of 32 g/L in the medium was supplemented during the 72-hour fermentor run with an additional 143 g/L added intermittently during the run. In similar fashion, the initial 2% (v/v) CSL concentration was augmented by the addition of an amount equivalent to 2% by volume of the initial volume at 32 hours and 59 hours. Cellulose concentration reached about 12.7 g/L during the fermentation. Throughout the fermentation, dissolved oxygen was maintained at about 30% air saturation.

Following fermentation, the cellulose was allowed to settle and the supernatant liquid poured off. The remaining cellulose was washed with deionized water and then extracted with 0.5 M NaOH solution at 60° C. for 2 hours. After extraction, the cellulose was again washed with deionized water to remove residual alkali and bacterial cells. More recet work has shown that 0.1 M NaOH solution is entirely adequate for the extraction step. The purified cellulose was maintaiend in wet condition for further use. This material was readily dispersible in water to form a uniform slurry.

Bacterial cellulose for the latter examples was made in 250 L and 6000 L fermenters.

The bacterial cellulose produced under stirred or agitated conditions, as described above, has a microstructure quite different from that produced in conventional static cultures. It is a reticulated product formed by a substantially continuous network of branching interconnected cellulose fibers.

The bacterial cellulose prepared as above by the agitated fermentation has filament widths much smaller than softwood pulp fibers or cotton fiber. Typically these filaments will be about 0.05–0.20 microns in width with indefinite length due to the continuous network structure. A softwood fiber averages about 30 microns in width and 2–5 mm in length while a cotton fiber is about half this width and about 25 mm long.

EXAMPLE 2

Method of Coating Bacterial Cellulose and Clay in Combination on Filter Paper The bacterial cellulose ("BAC") of the present invention, which was produced under conditions similar to Example 1, specifically Batch No. A-085, was washed to a pH of between 7 and 8 using dilute hydrochloric acid and water and then conbined with clay before surface coating, except for the 100% controls. Whatman #541 filter paper with an average basis weight of 78.9 g/m$^2$; was used as the substrate sheet upon which the BAC/clay mixture was applied in various combinations. The clay used was Hydraprint, Kaolin, a delaminated standard No. 2 fraction grade from J. M. Huber of Macon, Ga. The BAC used was 6.6% solids concentration before combination with clay and subsequent dilution. Prior to combination with the BAC, the clay was in a solid 100% concentration form. The target base weight for the BAC/clay surface coating plus filter paper was 80–90 g/m$^2$.

TABLE I

| | | Amounts in Grams of | |
|---|---|---|---|
| Sample | BAC,/Clay in % | BAC wet wt. | Clay dry wt. |
| 1 | 100/0 | 3.03 | 0.00 |
| 2 | 75/25 | 2.27 | 0.05 |
| 3 | 50/50 | 1.52 | 0.10 |
| 4 | 25/75 | 0.76 | 0.15 |
| 5 | 0/100 | 0.00 | 0.20 |
| 6 | 0/0 | Whatman #541 filter paper only | |

The area of filter paper coated was 0.02 m$^2$. The filter paper was coated by laying the filter paper on the forming wire in a British Sheet Mold. The mold was closed and approximately two (2) liters of water was poured on top of the filter paper. The BAC and clay were added to 1.5 liters of water. This BAC/clay solution and the 100% controls were mixed in a British Disintegrator for approximately four minutes at 3000 RPM and then each sample was added to the water in the mold. The water plus BAC/clay solution was agitated with air for 10 seconds and then drained through the filter paper. After draining, the filter paper was pressed at 50 p.s.i. (345 kPa) in a TAPPI press between blotters for 5 minutes. A second sheet of filter paper was placed on top of the coated filter paper to prevent the BAC/clay from sticking to the blotter paper. The pressed filter paper sheets were then dried in a steam heated drum dryer at approximately 100° C. The control filter paper which contained no BAC/clay, was treated in the same manner except the water passing through the clamped filter paper dit not contain any BAC/clay. The individual samples were conditioned at 50% relatively humidity (RH) then calendered at 400° F. (204° C.), 500 feet per minute (FPM) (152.4 meters per mintue) and 800 PLI (or approximately 6,500 psi peak or 4,700 psi average) ($1.4\times10^5$ newton per meter or approximately $4.48\times10^5$ kPa peak or $3.24\times10^5$ kPa average).

EXAMPLE 3

Comparison of Gloss, Ink Density, Roughness and Porosity Properties of BAC/Clay Coated Filter Paper Samples obtained by the process identified under Example 2, which were conditioned and calendered, were then tested under the below described testing procedures to test the properties outlined in Table II and Table III. The calendering developed the gloss of the sample. The 100% BAC and 75/25% BAC containing samples gave good printability that were superior to the samples containing clay alone or predominantly clay. The BAC containing samples demonstrated excellent gloss properties with a printed ink gloss and a sheet gloss difference of 20 points. Gloss of paper is the light reflectance from the paper's surface. A beam of light is projected onto the paper surface at an angle of 75° on a Hunterlab Modular Glossmeter Model D48D according to TAPPI Standard Method T480 and ASTM 1223-63T. The difference between the sheet gloss and the printed ink gloss is measured in points and is referred to as "snap."

The ink density was especially good for the 100% BAC and 75/25% BAC samples. Ink density is a measure of relative blackening of the printed image and is related to ink holdout on the surface of the paper. Ink density is measured to determine if the printed image has a consistent density through the run, or to determine if there is adequate ink coverage. Ink density was measured on a modified Prufbau-minidens densitometer. A scan of 11 cm per sample gives 280 individual readings with an end mean and standard deviation. The ink used was a standard heatset offset type oil base ink. Table II below outlines the above stated properties.

TABLE II

| GLOSS* AND INK DENSITY PROPERTIES | | | | |
|---|---|---|---|---|
| Sample | Coating** BAC/Clay | Sheet Gloss | Printed Ink Gloss | Ink Density |
| 1 | None | 24.7 | 20.5 | 1.44 |
| 2 | 100/0 | 43.1 | 62.7 | 1.89 |
| 3 | 75/25 | 37.3 | 60.5 | 1.84 |
| 4 | 50/50 | 41.5 | 47.2 | 1.65 |
| 5 | 25/75 | 44.3 | 32.4 | 1.45 |
| 6 | 0/100 | 21.8 | 23.2 | 1.13 |

*The gloss values are in percentage reflectance at a 75° angle.
**Levels applied in all cases correspond to 12 g/m$^2$ onto a 78 g/m$^2$ filter paper base sheet. Samples 5 and 6 did not retain all of the clay. Extensive clay picking seen in prints of samples 4, 5 and 6.

Table III below outlines the properties of porosity and roughness. Roughness was measured by the roughness average which is defined as the arithmetical average of the departures of the paper surface profile above and below the reference lines (or electrical mean line) throughout the prescribed sampling length. Roughness average was measured per Tallysurf 10 Operators Handbook, by Taylor-Hobson, on the Taylor-Hobson Tallysurf 10 Profilimeter, supplied by Rank Precision Industries of Des Plaines, Ill.

TABLE III

| ROUGHNESS AND POROSITY PROPERTIES | | | |
|---|---|---|---|
| Sample | Coating BAC/clay | Gurley Porosity sec/100 mL | Average Roughness Microns (S.D.) |
| 1 | None | 2.50 | 2.24(0.01) |
| 2 | 100/0 | >60,000 | 1.13(0.03) |
| 3 | 75/25 | 6,700 | 1.22(0.01) |
| 4 | 50/50 | 1,400 | 1.23(0.13) |
| 5 | 25/75 | 220 | 1.25(0.08) |

TABLE III-continued

| ROUGHNESS AND POROSITY PROPERTIES | | | |
|---|---|---|---|
| Sample | Coating BAC/clay | Gurley Porosity sec/100 mL | Average Roughness Microns (S.D.) |
| 6 | 0/100 | 5.8 | 1.81(one sample) |

The results recorded in Table III demonstrate the extraordinary ability of the samples containing BAC to fill pores and pits at the surface of the base filter paper sheets which dramatically affects the porosity and smoothness properties of the samples. Smoothness is inversely related to the roughness coefficient in the above Table III, therefore, the smaller the unit of roughness, the smoother the surface of the sample. The direct contribution of the BAC to the properties of porosity and smoothness is demonstrated by the extremely high results of the 100% BAC sample and the decrease in results with the decrease in BAC concentration in relation to increase in the clay concentration.

EXAMPLE 4

Method of Coating Bacterial Cellulose in Different Percentages by Add on Weight on Lightweight Base Sheets The BAC of the present invention, which was produced under conditions similar to Example, 1 specifically Batch No. A-085, was washed to a pH of between 7 and 8 using dilute hydrochloric acid and water except for the 100% control, which was only the lightweight base sheet. A lightweight base sheet of 50% kraft/50% thermomechanical pulp ("TMP") of all southern pine with an average basis weight of 48.8 g/m$^2$ was used as the base sheet for application of the BAC. A disc 16 centimeters in diameter was cut from the base sheet producing a base sheet with the average weight of 0.76 g/sheet. After being cut out, the disc was wetted thoroughly in water. The disc was then placed in a fritted filter funnel (Buchner funnel) with the wire side up. The wire side was the only side coated with the BAC in 1, 3, 5 and 10% add on dry weight as compared to the weight of the disc. The following Table IV is the actual wet weight in grams for the BAC added on at the respective percentage add on weights of BAC.

TABLE IV

| Sample | Add On % of Basis Dry Weight | Wet Weight of BAC* in Grams |
|---|---|---|
| 851 | 1% | 0.18 |
| 853 | 3% | 0.54 |
| 855 | 5% | 0.90 |
| 8510 | 10% | 1.81 |

The BAC was at 4.2% solids content.

Prior to addition onto the fritted filter funnel that contained the disc, the BAC solution was mixed in a British Disintegrator for approximately four minutes at 3000 RPM and then added to the fritted filter funnel. Drainage was facilitated by the use of suction. After draining, each sample was pressed at 50 p.s.i. (345 kPa) in a TAPPI press between blotters for 5 minutes. The pressed disc coated samples were then dried in a steam heated drum dryer at approximately 110° C. A base sheet only control was treated in the same manner as the samples that contained BAC, except the solution passing through the fritted filter funnel contained only water. The individual samples were conditioned to 50% RH, then calendered at 400° F. (204° C.), 500 FPM (152.4 m/min) and 800 PLI (or approximately 6,500 psi peak or 4,700 psi average) ($1.4\times10^5$ newton per meter or approximately 4.48 kPa$\times10^5$ peak or $3.24\times10^5$ kPa average.

EXAMPLE 5

Comparison of Gloss, Ink Density, Roughness, Surface Strength and % Brightness Properties of BAC only Coated Base Sheets with Other Types of Sheets The following Table V and attached graph, FIG. 1, demonstrate the properties of gloss and ink density of BAC only coated base sheets, made according to Example 4 above, as compared to other types of sheets. Table V gives the value for sheet gloss, ink gloss, gloss difference and ink density. The gloss difference, or snap, demonstrates the difference between the gloss of the inked print and the gloss of the underlying paper. The ink used was a standard heatset offset type oil base ink. Gloss measurements were determined by the same method as under Example 3. The control for the gloss test was an uncoated base sheet, as explained in Example 4 above.

The ink density was determined by the same method as under Example 3. Ink density is a measure of relative blackening of a printed image and is related to ink holdout on the surface of the paper.

TABLE V

| GLOSS* AND INK DENSITY PROPERTIES | | | | |
|---|---|---|---|---|
| Sample | Sheet Gloss | Ink Gloss | Gloss Difference | Ink Density |
| 851 | 31.8 | 43.0 | 11.1 | 1.41 |
| 853 | 35.6 | 48.7 | 13.0 | 1.46 |
| 855 | 41.1 | 53.3 | 12.2 | 1.49 |
| 8510 | 39.6 | 52.3 | 12.8 | 1.50 |
| Control | 29.2 | 34.8 | 5.6 | 1.33 |
| Offset** | 56.2 | 73.8 | 17.6 | 1.49 |
| Roto*** | 58.6 | 73.0 | 14.4 | 1.34 |

*The Gloss values are in percentage reflectance at a 75° angle.
**Offset refers to a commercial grade of offset printing paper.
***Roto refers to a commercial grade of rotogravure printing paper.

Table V demonstrates the difference in gloss properties between the BAC coated sheet and the offset rotogravure sheets, which are both used commercially. For example, 3% of BAC gives nearly the equivalent gloss difference as a rotogravure paper, which has a coating of approximately 20%, thus demonstrating the ability to achieve similar gloss property with less material. FIG. 1 compares the difference in printed ink gloss and sheet gloss to the percentage of BAC, applied to the surface, which demonstrates the high gloss difference achieved with a small percentage of BAC.

As regards ink density, the results are very similar to the commercial grades of offset and rotogravure which contain much higher levels of coating.

Table VI below outlines the properties of roughness, surface strength and % brightness drop for the BAC coated base sheets, made according to Example 4 above, as compared to offset and rotogravure printing paper. Roughness was measured by the same method as under Example 3.

Surface strength or IGT pick measures the resistance to picking of the paper surface under the stresses in the printing nip. The measurement of surface strength of IGT pick records the first visible signs of picking (or disruption of the surface) after it has been printed with a standard testing oil. An IGT value is called a VVP, velocity of the print multiplied by the viscosity of the standard testing oil. IGT pick was measured on a standard IGT Printability Tester AIC2 supplied by Technographics Instruments of San Angelo, Texas. The IGT AE inking device using 0.294 Kpoise standard testing oil, inked up 1 cm aluminum printing discs.

Ink Density and % Brightness Drop (K&N test) are tests which demonstrate the characteristic or property of ink/oil holdout. Ink/oil holdout demonstrates the resistance of a surface to oil penetration. The % Brightness Drop or K&N Brightness Drop is measured by first measuring the sample for brightness before the K&N ink is applied to the sample. Then K&N standard test ink is applied to the surface and allowed to set for two minutes. After two minutes, the K&N ink is wiped off using a soft cloth or paper towel. The sample is then measured on the Technidyne Model S-4 Brightness Tester at the area where the K&N ink was applied to the surface. This value is divided by the initial brightness value to obtain a percent brightness. This value is a measurement of the oil absorption characteristic of the paper. The ink used for all samples was standard K&N testing ink. The Technidyne Model S-4 Brighness Tester was supplied by Technidyne Corporation of New Albany, Ind.

TABLE VI

ROUGHNESS (SURFACE SMOOTHNESS), SURFACE STRENGTH AND % BRIGHTNESS DROP PROPERTIES

| | Surface Smoothness | | | |
|---|---|---|---|---|
| Sample | Sheet Roughness (μ) | Ink Roughness (μ) | Surface Strength IGT | % Brightness Drop |
| 851 | 1.69 | 1.56 | 7.3 | 22.8 |
| 853 | 1.54 | 1.72 | 8.3 | 3.7 |
| 855 | 1.57 | 1.67 | 6.6 | 10.1 |
| 8510 | 1.60 | 1.89 | 8.3 | 4.6 |
| Control | 1.70 | 1.89 | 10.1 | 37.4 |
| Offset | 0.75 | 0.82 | 23.2 | 35.2 |
| Roto | 0.90 | 0.91 | 6.5 | 16.4 |

It should be noted that the experimental BAC coated sheets are rougher than the commercial sheets because the latter sheets are supercalendered after coating. Surface strength is a critical property for offset papers which are highly coated and conditioned to provide very high surface strength. The offset process is especially demanding of paper surfaces; therefore, offset coatings are designed to meet that requirement. The experimental BAC coated sheets gave values with a small amount of BAC coating for surface strength comparable to the rotogravure sheets, which contain a much higher percentage of coating.

As regards % Brightness Drop, a relatively low vlaue, as evidenced by the BAC coated sheets, illustrates a higher degree of ink holdout. In particular, relative to the control, the BAC coated sheets demonstrate lower % Brightness Drop and, therefore, better ink/oil holdout than the uncoated control sheet.

EXAMPLE 6

Surface Coating Application on a Noble and Wood Paper Machine

A Noble and Wood Pilot Paper Machine was used to form a two layer sheet consisting of a base ply of paper furnish amounting to 95% of the total sheet basis weight, and a top ply of BAC equivalent to 5% of the total sheet basis weight. The base ply paper used was 50% sulfite hardwood and 50% TMP southern pine softwood. The base ply paper was prepared by mixing together a 50/50 slurry of sulfite hardwood (400–450 CSF) and TMP southern pine softwood (approx. 70 CSF), with a resulting CSF for the mixture of 125.

The BAC, prepared according to Example 1 except in a 6000 L stirred fermenter, Batch No. A-126, was divided into separate trials. The first trial of BAC at the consistency of approximately 13%, consisted of 16 samples, 30 g OD and 1.5% consistency each, which were placed in a British Disintegrator for approximately 30 minutes. After disintegration, the 16 samples were combined and then placed in a 400 liter mixing tank for one hour. After such mixing, the combined samples were diluted with water to a consistency of approximately 0.76 g/L (0.076% consistency). The second trial of BAC, consisting of BAC at a consistency of approximately 13%, was not first placed in a British Disintegrator but was diluted to a consistency of approximately 0.7 g/L (0.076% consistency) and then stirred in a 400 liter mixing tank for approximately 45 minutes. Therefore, the difference between the first and the second trials is that the first trial was placed in a British Disintegrator before the mixing tank and the second trial was not placed in the British Disintegrator, but only the mixing tank. The first trial is hereinafter referred to as BAC refined and the secon trial is hereinafter referred to as BAC regular.

The BAC slurry (use of the singular "BAC" refers to both BAC refined and BAC regular, although the BAC refined and the BAC regular were applied in separate runs, the "slurry" refers to the final 0.076% consistency which resulted from the above procedure) was applied as a surface layer via a secondary headbox on the Noble and Wood machine. The secondary headbox was mounted just after the base ply sheet dry line, which was where the solids content of the base ply sheet was approximately 5–6%. The base ply sheet was formed at 66 g/m$^2$ OD and the BAC was added through the secondary headbox, as previously discussed, at the rate of 9 L/min of BAC slurry with the BAC slurry diluted further at the secondary headbox with 5 L/min of water, which was added with a hose. Next, the BAC pump was turned off and the hose flow was increased to 14 L/min for approximately 30 minutss to form the control sheet. The control was the base ply sheet only, with the BAC removed from the BAC/water stream and water running through the secondary headbox at the same rate as the BAC/water stream. After the application of the BAC slurry, the sheet was processed normally through the Noble and Wood Machine. The finished rolls were stored at 50% RH until calendering was performed. The sheets were calendered as described in Example 4.

EXAMPLE 7

Figure 2:
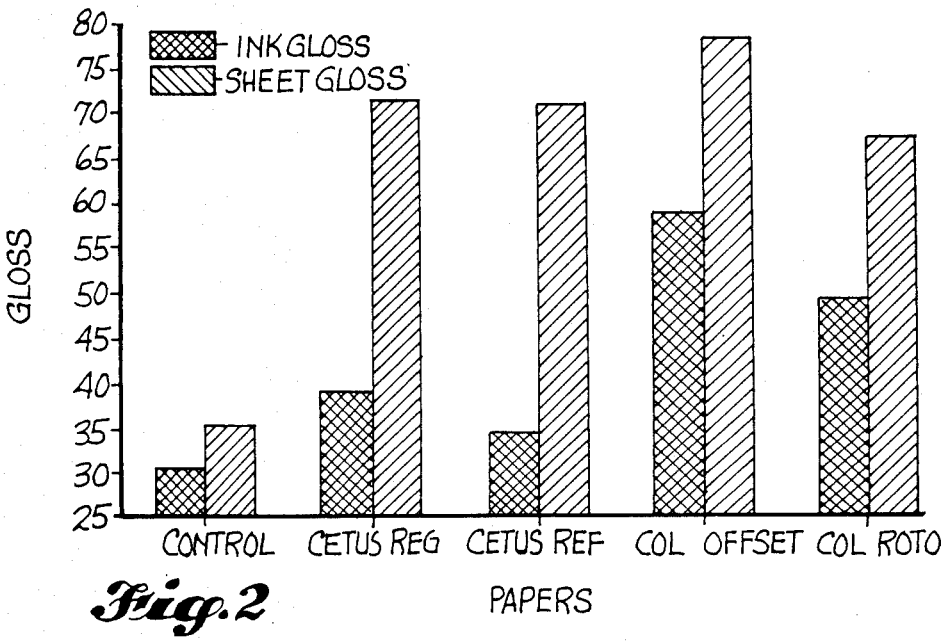
FIG. 2 is a graph comparing gloss versus percentage (%) of bacterial cellulose applied to demonstrate the effect of a coating of bacterial cellulose on the gloss property of lightweight coated base sheets.

Comparison of Measured Properties of the BAC Coated Sheets Made on a Noble and Wood Paper Machine with Other Types of Sheets (a) Comparison of Gloss Properties of the BAC Coated Sheets with Other Types of Sheets The following Table VII and attached graph, FIG. 2, demonstrate the superior gloss property, particularly the snap property, of BAC coated sheets made on the Noble and Wood Paper Machine, according to Example 6 abové, as compared to other types of sheets. Snap is the difference between the gloss of the inked print and the gloss of the unprinted paper. This superior snap property, demonstrated by the BAC coated sheets, is valuable because it emphasizes reflection of light from the ink as compared with reflection of light from the paper. This property is very useful in magazines and other types of glossy print or advertisements which use the snap characteristic to dramatize the print or photograph. The greater the snap the more the printed material has the appearance of "jumping off" the page at the reader. The ink used was a standard heatset offset type of oil base ink. Gloss measurements were determined by the same method as under Example 3. The control for the gloss test was an uncoated sheet made on the Noble and Wood Paper Machine as explained in Example 6 above.

TABLE VII

| GLOSS* PROPERTIES | | | | |
|---|---|---|---|---|
| Sample | Description | Sheet Gloss | Ink Gloss | Gloss Diff |
| 1-2 | Control | 31.2 | 34.5 | 3.3 |
| 2-2 | BAC Reg** | 38.3 | 62.7 | 24.4 |
| 3-2 | BAC Ref*** | 35.1 | 61.0 | 25.9 |
| 10-2 | Offset | 57.9 | 75.3 | 17.4 |
| 11-2 | Roto | 49.5 | 65.5 | 16.0 |

*The gloss values are in percentage reflectance at a 75° angle.
**BAC Reg refers to BAC Regular which was dispersed in a mixing tank only.
***BAC Ref refers to BAC Refined which was dispersed in a British Disintegrator and then a mixing tank as described above in Example 8.

Table VII and FIG. 2 demonstrate that the characteristic of snap or gloss difference is significantly superior for the BAC coated paper as opposed to the commercial grade papers.

(b) Comparison of Ink Density and % Brightness Drop Properties of the BAC Coated Sheets with Other Types of Sheets The following Table VIII demonstrates the superior % Brightness Drop and Ink Density properties of BAC coated sheets made on a Noble and Wood paper machine, as compared to other grades or types of sheets, such as offset and rotogravure. The Ink Density was measured by the same method as in Example 3. The % Brightness Drop or K&N Brightness Drop was measured by the same method as in Example 5 above. The controls for Ink Density and % Brightness Drop tests were uncoated sheets made on the Noble and Wood Paper Machine as explained in Example 6 above.

TABLE VIII

| INK DENSITY AND % BRIGHTNESS DROP PROPERTIES | | | |
|---|---|---|---|
| Sample | Description | Ink Density | % Brightness Drop |
| 1-2 | Control | 1.41 | 42.8 |
| 2-2 | BAC Reg | 1.71 | 9.4 |
| 3-2 | BAC Ref | 1.69 | 8.0 |
| 10-2 | Offset | 1.80 | 17.3 |
| 11-2 | Rotogravure | 1.67 | 31.0 |

As evidenced by the results in Table VIII, the BAC containing samples show very favorable ability to hold ink at the surface of the sheet, i.e., restrict penetration into the sheet. In addition, the BAC coated sheets demonstrate superior % Brightness Drop results.

Figure 3:
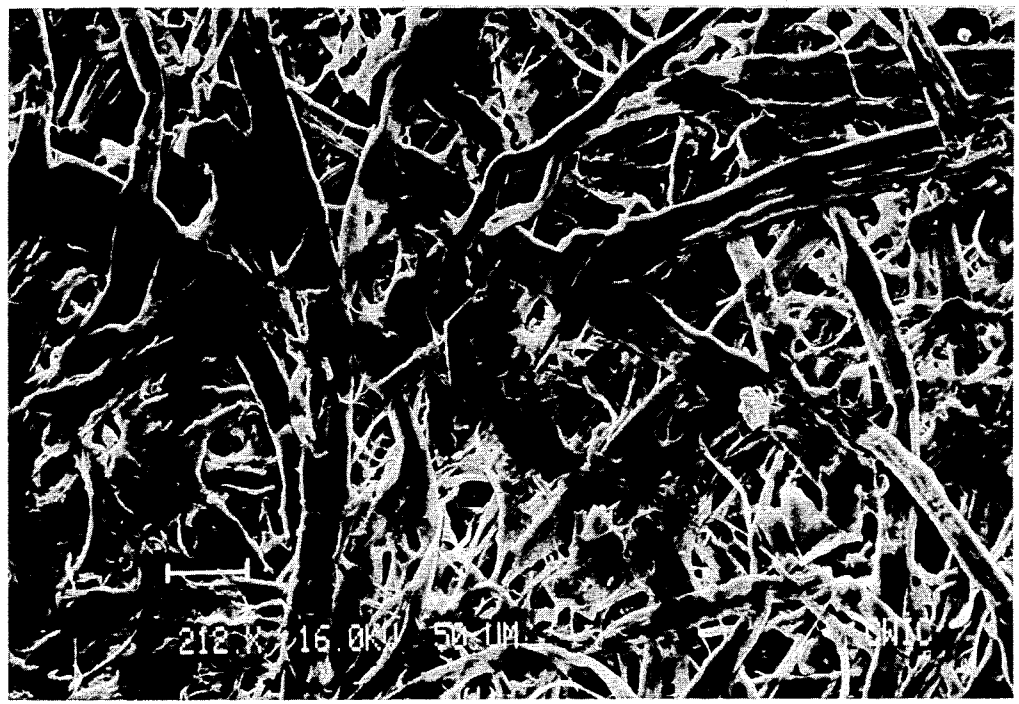
FIGS. 3 and 4 are scanning electron micrographs, on which the bar represents 50 microns.
Figure 4:
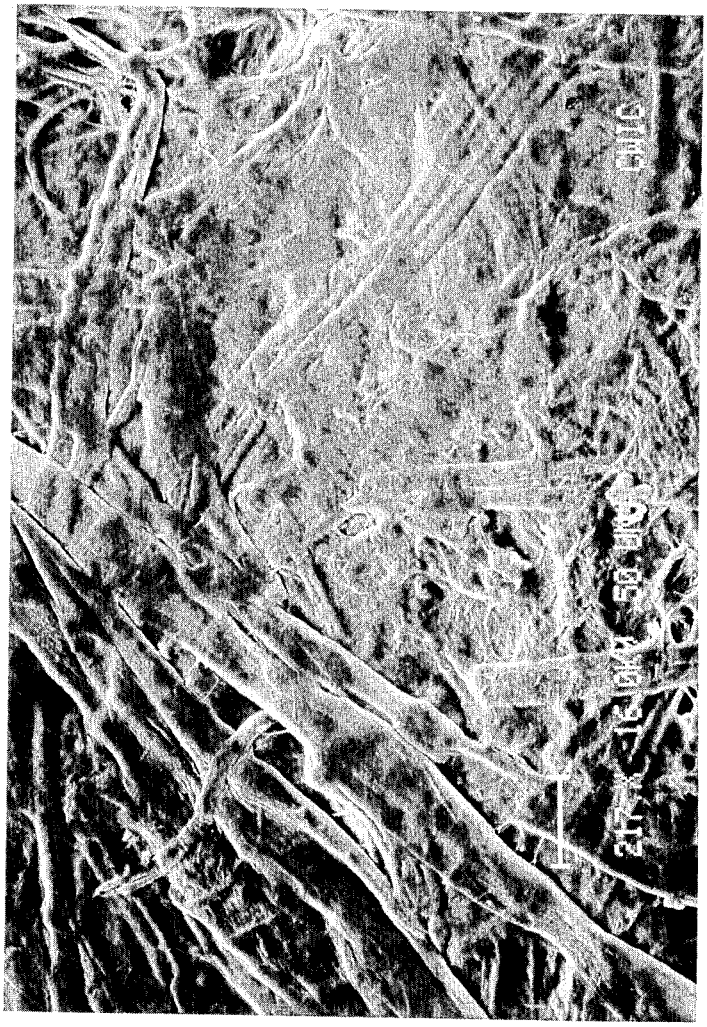

(c) Comparison of Surface Smoothness and Surface Strength Properties of the BAC Coated Sheets with Other Brands or Types of Sheets The following Table IX demonstrates the superior surface smoothness and surface strength of the BAC coated sheet over other brands or types of sheets. The attached photographs, FIGS. 3 and 4, evidence the surface smoothness property of a BAC coated sheet as compared to the control. Surface smoothness measures the comparative roughness of the unprinted sheet without or with the BAC surface coating as demonstrated in FIGS. 3 and 4 respectively. Surface smoothness also demonstrates the condition of the surface which will affect the ability to receive other surface coatings. With the addition of a very small quantity of BAC, as evidenced by the small concentration of BAC in the samples, the concentration or amount of other surface coatings necessary to cover the surface is significantly decreased due to the surface smoothness of the BAC coated surface. Very little BAC is needed to sufficiently coat the underlying sheet to create the smooth surface for either further surface application or printing application, thus saving the normal cost of other surface coatings. The measurement of surface smoothness was accomplished by the same method as in Example 3.

Surface strength of IGT pick measures the resistance to picking of the paper surface under the stresses in the printing nip. Surface strength of IGT pick was measured by the same method as in Example 5 above.

TABLE IX

| SURFACE SMOOTHNESS AND SURFACE STRENGTH PROPERTIES | | | | |
|---|---|---|---|---|
| | | Surface Smoothness | | Surface |
| Sample | Description | Sheet Rough | Ink Rough | Strength IGT |
| 1-2 | Control | 1.63 | 1.64 | 5.6 |
| 2-2 | BAC Reg | 1.39 | 1.27 | 21.3 |
| 3-2 | BAC Ref | 1.45 | 1.32 | 25.8 |
| 10-2 | Offset | 0.69 | 0.67 | 30.9 |
| 11-2 | Roto | 0.78 | 0.80 | 6.2 |

As evidenced by the results in Table IX, the BAC containing sheets have a significantly smoother surface, both the sheet itself and the printed sheet, than the control. Regarding IGT pick or surface strength, the commercial grade of papers are supercalendered to achieve a smooth surface whereas the BAC coated sheets showed significant improvement in surface smoothness with only the single thermal nip calendering treatment which involves less expense both in time and capital outlay to achieve a superior surface smoothness. It is interesting to note that the surface strength values for the BAC coated sheets were significantly higher than the rotogravure sheets results and approaching the value for the offset sheet results, but without the use of supercalendering.

EXAMPLE 8

Comparison of Measured Properties of BAC Coated Sheets Made on a Laboratory Dynamic Former with Commercially Available Papers The Laboratory Dynamic Former is a device which much more nearly simulates a paper machine than the conventional sheet mold. It comprises a rotating cylindrical forming wire. Stock is flowed or sprayed on the inner surface by a vertically reciprocating supply tube. A device of this type is available from Centre Technique de l'Industrie des Papier, Cartons et Celluloses Grenoble, France. Sheets may be layered as desired by sequentially using stock from selected sources. Sheet size is approximately 840×200 mm, considerbaly larger than those produced in standard sheet molds.

The Dynamic Former was used to prepare sheets coated with three levels and two preparation schedules of bacterial cellulose. Base sheet stock was 65% bleached southern kraft hardwood fiber and 35% bleached softwood kraft. The softwood kraft was refined in a Valley beater to about 425 CSF before mixing with the unrefined hardwood fiber.

The bacterial cellulose was dispersed at low consistency in a British Disintegrator. One portion was further homogenized in a high shear Cowles mixer.

Sheets were made to a basis weight of about 75 g/m$^2$. Following formation of the base sheet, the bacterial cellulose stock slurry was applied to give one side surface coatings of about 1.0, 0.5, and 0.3%, based on total sheet weight. The homogenized BAC was used only at the 1% level.

Following drying, the sheets were hot calendered as described in Example 4.

A control sheet was prepared as above but without any BAC surface treatment. All of the sheets were then tested for printing properties as described in the previous examples. A commercially available lightweight coated offset paper and a similar uncoated offset paper were tested as comparisons.

Table X shows the properties achieved.

TABLE X

| Sample Description | Sheet Gloss | Ink Gloss | Gloss Difference | Ink Density | Sheet Brightness | K & N Brightness Drop, % | IGT Pick | Sheet Roughness |
|---|---|---|---|---|---|---|---|---|
| Control | 32.5 | 35.5 | 3.0 | 1.31 | 85.1 | 45.0 | 7.4 | 1.51 |
| 1% BAC Homogenized | 39.8 | 42.2 | 2.4 | 1.33 | 83.0 | 19.0 | 9.1 | 1.37 |
| 1% BAC | 46.4 | 56.0 | 9.6 | 1.39 | 79.8 | 17.4 | 7.6 | 1.12 |
| 0.5% BAC | 36.3 | 39.8 | 3.5 | 1.32 | 84.1 | 32.6 | 8.1 | 1.37 |
| 0.3% BAC | 35.5 | 39.6 | 4.1 | 1.32 | 84.3 | 31.4 | 7.9 | 1.38 |
| Lightweight Coated Offset Paper | 57.1 | 69.3 | 12.2 | 1.47 | 72.7 | 19.3 | 35.1 | 0.85 |
| Uncoated Offset Paper | 7.6 | 10.8 | 3.2 | 1.16 | 83.8 | 59.0 | 130.8 | 2.67 |

Gloss difference for the sheets coated with 1% BAC approaches that of the high quality coated offset paper. It is unclear why the homogenized BAC did not perform well in this test. As would be expected, the lower usages of BAC did not perform as well as the 1% level. However, all of the AC treated samples were superior in performance to the uncoated offset paper at every level of usage. It is evident that very low usages of BAC are effective at improving surface quality.

EXAMPLE 9

Preparation and Properties of BAC Coated Sheets—Two Side Coated Using a Size Press A bacterial cellulose suspension applied as a surface coating during wet end formation will inherently migrate into the sheet to some extent. This may be very desirable for some purposes. However, it tends to be an inefficient way to apply BAC when the intended purpose is to improve surface properties for printing. Surprisingly, slurries of BAC fiber can be effectively applied to base stock at a conventional size press or by using one of several well known types of coaters.

To show the effectiveness of bacterial cellulose applied by a size press, a run was made using a 71 g/m$^2$ base stock with a 460 mm wide inclined pilot scale size press. The raw stock was an unsized, in terms of having no size press applied surface sizing, bleached kraft eastern softwood electrographic copy paper base. Bacterial cellulose fiber was dispersed in water and run into a Deliteur mixer. Low viscosity carboxymethyl cellulose (CMC) was added in the ratio of 2.5 parts BAC (dry basis) to 1 part CMC. The CMC was used to improve uniformity of the BAC suspension. A suitable grade of CMC is available from Hercules, Inc., Wilmington, Delaware as type 7 L.

A first run was made at a speed of 150 m/min applying 4.15 kg/T total solids (BAC+CMC) to both sides of the sheet from a suspension having about 0.6% total solids content.

A second run was made at an operating speed of 260 m/min with a solids application of about 5 kg/ton, again applied to both sides of the sheet.

Total BAC usage in the first sample was thus about 0.3% total or about 0.15% on each face of the sheet. The second sample usage was about 0.36% total or about 0.18% on each face.

No problems were noted in making the run. Even higher sheet speeds appeared feasible but were limited in this case by the dryer capacity following the size press.

The finished coated samples and a base rawstock sample were hot calendered before testing, as described in Example 4.

Table XI shows the properties of the treated sheets compared with untreated base stock, finished (conventionally sized) electrographic copy paper, and a high grade lightweight coated offset paper.

TABLE XI

| Sample Description | Sheet Gloss | Ink Gloss | Gloss Difference | Ink Density | Sheet Brightness | K & N Brightness Drop, % | Sheet Roughness |
|---|---|---|---|---|---|---|---|
| Base Raw Stock(1) | 26.5 | 33.8 | 7.3 | 1.51 | 78.9 | 35.5 | 1.10 |
| 0.30% BAC at 150 m/min | 39.2 | 50.1 | 10.9 | 1.57 | 77.9 | 34.4 | 1.18 |
| 0.36% BAC at 260 m/min | 38.6 | 50.1 | 11.5 | 1.58 | 78.5 | 25.7 | 1.12 |
| Electrographic Copy Paper(2) | 7.6 | 15.5 | 7.9 | 1.35 | 78.1 | 42.9 | 2.60 |
| Lightweight Coated Offset | 55.1 | 68.5 | 13.4 | 1.56 | 69.2 | 18.7 | 0.85 |

(1)This paper was made without any surface sizing.
(2)A fully sized finished paper.

The improvement in print properties such as gloss difference and brightness drop over the base stock are immediately apparent. The sample with the higher BAC usage run at a higher speed approached the high grade offset paper in properties.

EXAMPLE 10

Preparation and Properties of BAC Coated Sheets—Second Size Press Run

An additional size press coating run was made in similar fashion to the run just described in Example 9. However, an expanded set of treatments was used. BAC and homogenized BAC were run with and without carboxymethyl cellulose. The ratio of BAC to CMC was increased to 4:1. In addition, runs were made with CMC alone and cooked starch alone. One run was made in which the base stock was treated with 442 kg/T of water only at the size press so that it would have similar wetting and drying to the other samples. Sheet speed through the size press was varied between 150 and 305 m/min.

Ink roughness was not measured for these samples. However, two new measurements were made: Parker Print-Surf and Gurley sheet porosity. Gurley porosity is a well known test and measures the time in seconds under standards conditions for 100 mL of air pass through the sheet. Parker Print-Surf is another measure of surface roughness. It is an air leak-type of test measured under conditions similar to those experienced on a printing press. This is now a standard I.S.O. Method for measurement of surface roughness of paper and board. Apparatus for carrying out the test is available from H. E. Messmer Ltd., London, England.

Table XII shows the operating speed at the size press, solids content of the coating, and solids pickup. Table XIII gives properties of the treated sheets. All sheets except the one designated were hot nip calendered on the wire side and print tests were made on that surface. One sample was calendered and printed on the felt side for a comparison.

TABLE XII

| Sample Description | Solids, % | Pickup kg/T[1] | Speed m/min |
|---|---|---|---|
| Base Raw Stock-Untreated | — | — | — |
| Raw Stock-Water Treated | — | —[2] | 305 |
| BAC | 0.70 | 6.8 | 213 |
| Homogenized BAC | 0.65 | 3.0 | 213 |
| BAC + CMC | 0.77 | 3.5–4.5 | 213 |
| Homogenized BAC + CMC | 1.0 | 5.75 | 213 |
| Homogenized BAC + CMC – Felt | 1.0 | 5.75 | 213 |
| CMC | 0.6 | 2.8 | 152 |
| Starch | 7.0 | 41.5 | 152 |
| Lightweight Coated Offset | — | — | — |

[1]Total for both sides of sheet.
[2]Water only.

The sheets size press coated with the BAC-CMC mixture had excellent print properties which approached the commercial lightweight coated offset papers. Apparently the CMC acts as a suspending and dispersing agent for the bacterial cellulose. This, in turn, appears to give a considerably more uniform and pore free coating on the raw stock surface, as indicated by the air porosity values. CMC and BAC are clearly synergistic in this regard. CMC by itself was little different from the water treated control sheet in all properties except brightness.

Other suspending agents besides CMC are expected to be equally useful. These would include both natural and synthetic material such as water soluble cellulose ethers. Experiments made using Alco gum showed it to be equivalent to CMC. Alco gum is supplied in the form of a reactive acidic emulsion based on a copolymer of methacrylic acid and ethyl acrylate and is available from Alco Chemical Co., Chattanooga, Tenn.

The sample coated with starch simulated the surface sizing that would normally have been applied to the base raw stock.

EXAMPLE 11

Preparation of One Side BAC Coated Sheets

In the inclined size press trials just reported, both sides of the base stock sheet were coated. For many paper products it is only necessary for one side to have superior printing characteristics. Trials were made on pilot scale short dwell and blade metering coaters to show the feasibility of applying bacterial cellulose to only one side of a sheet using equipment which closely simulated commercial operation. A short dwell coater has a head operating against a base roll with the sheet passing between them. A puddle of coating is maintained against the rapidly moving web. This is doctored by a blade at the exit portion of the head to the desired coating weight. The blade metering coater is quite similar. Here the head lays the coating directly on the base roll rather than directly onto the paper. The premetered coating is then transferred to the moving paper web where at another location it is in contact with the base roll.

As with the trials of Examples 8 and 9, the base stock was an electrographic paper that had not received surface sizing. The applied coating was 4:1 mixture of BAC and low viscosity CMC. The BAC/CMC mixture had 1.0% total solids content. This was applied to the wire

TABLE XIII

| Sample Description | Sheet Gloss | Ink Gloss | Gloss Difference | Ink Density | Sheet Brightness | K & N Brightness Drop, % | Sheet Roughness | Parker Print-Surf | Gurley Air Porosity |
|---|---|---|---|---|---|---|---|---|---|
| Base Raw Stock-Untreated | 35.7 | 39.5 | 3.8 | 1.18 | 79.9 | 43.3 | 1.33 | 1.97 | 50.8 |
| Raw Stock-Water Treated | 38.8 | 41.1 | 2.3 | 1.14 | 80.7 | 38.1 | 1.32 | 1.96 | 47.4 |
| BAC | 35.7 | 38.2 | 2.5 | 1.16 | 80.4 | 36.5 | 1.38 | 1.94 | 61.2 |
| Homogenized BAC | 33.1 | 37.1 | 4.0 | 1.27 | — | 40.5 | 1.46 | 2.23 | 47.6 |
| BAC & CMC | 38.2 | 46.1 | 7.9 | 1.28 | 80.8 | 32.2 | 1.33 | 1.89 | 143.6 |
| Homogenized BAC + CMC | 40.4 | 45.2 | 4.8 | 1.23 | 80.3 | 32.7 | 1.24 | 1.73 | 186.1 |
| Homogenized BAC + CMC–Felt[1] | 40.7 | 50.8 | 10.1 | 1.41 | 80.4 | 22.7 | 1.00 | 1.36 | 271.2 |
| CMC | 39.2 | 41.6 | 2.4 | 1.28 | 82.4 | 36.7 | 1.36 | 2.01 | 55.9 |
| Starch | 40.4 | 45.4 | 5.0 | 1.20 | 79.9 | 32.7 | 1.43 | 2.32 | 57.3 |
| Lightweight Coated Offset | 46.6 | 58.7 | 12.1 | 1.47 | — | 21.9 | 0.89 | 0.98 | 718.5 |

[1]Hot nip calendered on felt side of sheet. All others except untreated base raw stock calendered on wire side of sheet.

side of the base stock using the short dwell coater and the felt side with the blade metering coater.

Tests were run at speeds of 397 m/min on the blade metering coater and 305 m/min on the short dwell coater. The applied coating on the short dwell run was only 1.65 kg/T, equivalent to 1.32 kg/T of BAC. Coating weight on the blade metering run was about 2 kg/T equivalent to about 1.6 kg/T of BAC.

All samples were hot nip calendered as described in Example 4, prior to printing and testing.

TABLE XIV

| Sample Treatment | Sheet Gloss | Ink Gloss | Gloss Difference | Ink Density | Sheet Brightness | K & N Brightness Drop, % | Sheet Roughness | Parker Print-Surf | Gurley Air Porosity |
|---|---|---|---|---|---|---|---|---|---|
| Blade Metering Coater | 36.9 | 43.1 | 6.2 | 1.28 | 80.6 | 28.2 | 1.20 | 1.59 | 196.5 |
| Short Dwell Coater | 38.8 | 40.8 | 2.0 | 1.20 | 80.6 | 34.3 | 1.31 | 1.88 | 70.8 |

Significant improvement in printing properties over the base stock were especially evident for the blade metering trial. These were somewhat equivocal for the short dwell trial where gloss difference was poorer than base stock but other properties were superior. It must be noted that these improvements were attained at very low coating weights.

With the information contained herein, various departures from the precise description of the invention will be readily apparent to those skilled in the art to which the invention pertains without departing from the spirit of the invention claimed below. The present invention is not to be considered limited in scope to the procedures, properties or components defined since the examples and other descriptions are intended only to be illustrative of particular aspects of the invention. Any procedure, property or method of producing similar products which are functionally equivalent to those described are considered to be within the scope of the invention.

We claim:

1. A method of making a treated fibrous web which comprises applying a coating of a bacterial cellulose having a reticulated structure from an aqueous suspension to at least one surface of a substrate fibrous web.

2. The method of claim 1 in which the bacterial cellulose is produced under agitated aerobic culture conditions by a bacterium of the genus Acetobacter.

3. The method of claim 1 which comprises wet forming the substrate web and applying the bacterial cellulose coating during the wet formation.

4. The method of claim 1 which comprises applying the bacterial cellulose suspension of an at least partially dried substrate web.

5. The method of claim 4 in which the bacterial cellulose suspension is applied to the substrate web using a size press.

6. The method of claim 4 in which the bacterial cellulose suspension is applied to the substrate web using a coater.

7. The method of claims 1, 2, 3, 4, 5, or 6 in which the aqueous bacterial cellulose suspension further includes a suspending and dispersing agent.

8. The method of claim 7 in which the suspending and dispersing agent is carboxymethylcellulose.

9. The method of claims 1, 2, 3, 4, 5, or 6 in which the aqueous bacterial cellulose suspension further includes a filler or pigment.

10. The method of claim 7 in which the aqueous bacterial cellulose suspension further includes a filler or pigment.

11. A treated fibrous web which comprises a fibrous substrate web having on at least one surface thereof a coating of a bacterial cellulose having a reticulated structure.

12. The product of claim 11 in which the bacterial cellulose is produced under agitated aerobic culture conditions by a bacterium of the genus Acetobacter.

13. The product of claim 11 in which both surfaces of the product are coated with bacterial cellulose.

14. The product of claims 11, 12, or 13 in which the bacterial cellulose comprises less than 50 kg/T of product.

15. The product of claims 11, 12, or 13 in which the bacterial cellulose coating further includes a pigment or filler.

16. The method of claim 1 which further includes drying the coated web.

17. The method of claim 16 which further includes calandering the dried coated web.

18. The method of claim 1 in which only one surface of the substrate fibrous web is coated with bacterial cellulose.

19. The method of claim 1 in which both surfaces of the substrate fibrous web are coated with bacterial cellulose.

20. The method of claim 9 in which the filler is clay.

21. The method of claim 1 in which the bacterial cellulose is applied in combination with starch.

* * * * *